United States Patent [19]

Sun

[11] Patent Number: 4,890,077

[45] Date of Patent: Dec. 26, 1989

[54] FET MONOLITHIC MICROWAVE INTEGRATED CIRCUIT VARIABLE ATTENUATOR

[75] Inventor: Horng-Jye Sun, Fremont, Calif.

[73] Assignee: Teledyne MEC, Mountain View, Calif.

[21] Appl. No.: 329,625

[22] Filed: Mar. 28, 1989

[51] Int. Cl.[4] ..... H01P 1/22

[52] U.S. Cl. ..... 333/81 A; 307/568; 357/22

[58] Field of Search ..... 333/81 R, 81 A; 307/540, 568, 264

[56] References Cited

FOREIGN PATENT DOCUMENTS 148706 7/1985 European Pat. Off. ..... 333/81 A

OTHER PUBLICATIONS

DC to 20 HGZ MMIC GaAs FET Matched Attenuator, N/A-Com Advanced Semiconductor for Operations, p. 195, Microwave Journal, Mar. 1986.

*Primary Examiner*—Paul Gensler

*Attorney, Agent, or Firm*—Townsend & Townsend

[57] ABSTRACT

A MMIC variable attenuator uses depletion mode Schottky gate FETS as variable conductance devices in a "$\pi$" configuration to vary attenuation as a function of a DC control voltage. Attenuation is flat within $\pm 1$ dB, VSWR is $\leqq 2:1$ throughout the operating frequency and control voltage range, and about 12 dB variable attenuation is provided. The "$\pi$" is formed by FETs in shunt to ground between attenuator input and output, and by a FET in series between input and output. Resistors and an inductor connected in parallel with the series FET extend attenuator bandwidth to 20 GHZ and improve attenuation linearity versus control voltage. A resistor in series with each shunt FET also improves linearity. The typically 0 to $+3$ VDC control voltage is applied to the FET gates and drain/source leads permitting attenuation control with a single control voltage. FR power capability is increased without degrading RF performance by using multi-gate FETs wherein the ratio of gate width to number of gates is maintained substantially constant compared to a single-gate FET. Series-connected FETs further increase attenuator RF power capability. Operating from 2–20 GHz, embodiments using a single control voltage handle about 30 mW RF input power and use single-gate and dual-gate FETs, and handle about 250 mW RF input power and use triple-gate FETs. A third embodiment, operating from DC-20 GHz and handling about 500 mW RF input power, employs dual-gate FETs throughout and requires two complementary control voltages.

38 Claims, 13 Drawing Sheets

| | $Q_{100}$ | $Q_{200}$ | $Q_{300}$ |
|---|---|---|---|
| $V_c = 0$ | OFF | OFF | OFF |
| $V_c = V_p$ | ON | ON | ON |
| $V_c'$ | | | |

| | $Q_{100}$ | $Q_{200}$ | $Q_{300}$ |
|---|---|---|---|
| $V_c = 0$ $(V_c' = V_p)$ | OFF | OFF | ON |
| $V_c = V_p$ $(V_c' = 0)$ | ON | ON | OFF |

| | $Q_{100}$ | $Q_{200}$ | $Q_{300}$ |
|---|---|---|---|
| $V_c = 0$ | OFF | OFF | ON |
| $V_c = V_p$ | ON | ON | OFF |

FET MONOLITHIC MICROWAVE INTEGRATED CIRCUIT VARIABLE ATTENUATOR

BACKGROUND OF THE INVENTION

The invention relates to microwave frequency variable attenuators and more particularly to a monolithic microwave integrated circuit (MMIC) variable attenuator incorporated into a microstrip transmission line system.

The use of a microstripline waveguide formed as part of an MMIC in a microwave system that includes a microwave amplifier is known in the art. The nominal gain of such an amplifier in a microwave system can vary unit-to-unit by 10 dB or more due to production variables. In practice, a microwave attenuator follows the amplifier to reduce the amplifier output to a reference level. Known MMIC attenuators typically use PIN diodes or field effect transistors (FETs) often in a "$\pi$" or "T" configuration.

Prior art MMIC microstripline attenuators are deficient in several respects. They generally require two opposite polarity power supplies for operation and require that two independent DC control voltages be changed simultaneously to vary attenuation while maintaining a substantially constant attenuator input and output impedance typically 50 Ω. Adjustment of the two control voltages is critical and often very non-linear. Known MMIC microstripline attenuators cannot maintain attenuation flatness within 0.5 dB over a bandwidth of 2–20 GHz. Further, such attenuators exhibit limited dynamic range often less than 10 dB at maximum attenuation and cannot readily handle power in excess of about 0.25 W.

SUMMARY OF THE INVENTION

The present invention provides a FET attenuator circuit that is integrated into the typically GaAs, semi-insulating substrate of a microwave monolithic integrated (MMIC) microstripline. A layer of metal is deposited on one surface of the substrate and the MMIC FET attenuator circuit is fabricated on the other surface. First and second preferred embodiments of an attenuator according to the present invention operate from a single polarity, preferably positive power source and use a single control signal to vary attenuation in a predictable and well controlled manner over a 2–20 GHz frequency range. A third embodiment provides attenuation over a 0–20 GHz frequency range. An attenuator according to the present invention may be included as a component in a microwave system to attenuate RF microwave signals coming from the output of an amplifier or some other RF signal source.

The present invention includes an RF circuit input port to which the input signal to be attenuated is connected an RF circuit output port from which an attenuated fraction of the input signal (i.e., the attenuated input signal) is delivered to a load a control port for receiving a single control signal Vc whose magnitude varies the attenuation of the present invention and first and second voltage reference ports for receiving first and second reference voltages, Vp and Vg, respectively.

The present invention also includes three variable conductance active devices which are connected in a "$\pi$" configuration. The vertical legs of the "$\pi$" are formed by the first and second active devices connected to shunt the signal at the RF circuit input port and RF circuit output port. Respectively, while the horizontal portion of the "$\pi$" is a third active device connected in series between the RF circuit input and RF circuit output ports. A multi-Schottky gate FET having increased power handling capabilities without significant degradation of RF small signal characteristics compared to a single-Schottky gate FET is also disclosed. In the preferred embodiments, power dissipation and high frequency response is increased by making each shunt active device a depletion mode FET having at least two Schottky gates (or control leads).

The present invention further includes bias means to establish FET bias levels from the first and second reference voltages, control voltage means for varying the conductance of each FET as the magnitude of the single control signal varies, and circuit compensation means to extend the upper frequency range of the attenuator, to maintain a substantially constant RF circuit input port and RF output port impedance throughout the frequency range of interest, and to linearize the circuit attenuation as a function of the single control voltage Vc.

In the first preferred embodiment, each FET is connected to the bias means such that an output lead of each shunt FET (i.e., the first and second active devices) is connected to the first voltage reference Vp, typically the absolute value of the common pinch-off voltage of the FETs and the gates of the series FET (i.e., the third active device) are connected to the second voltage reference Vg, typically ground. Reference hereafter will be made to "the positive value of the pinch-off voltage" to minimize confusion as to polarity. In this embodiment, each FET is also connected with the control voltage means such that the control signal Vc at the control port is presented to the gates of the shunt FETs and to an output lead of the series FET. It is the connection of the control signal Vc to an output lead of the series FET (in addition to the more conventional connection with the gate leads of the shunt FETs) that permits varying attenuation with a single control voltage.

A second preferred embodiment is similar to the first embodiment, but the active devices are triple gate FETs. In this embodiment the first and second active devices are series-connected triple gate FETs, and an output lead of the bottom-most FET in the series-connected FETs is connected to the first voltage reference Vp.

A third embodiment capable of attenuating down to DC and dissipating 500 mW, uses series-connected FETs for each active device. The series-connected FETs comprising the first and second active devices have an output lead of the bottom-most FET connected to the first voltage reference Vp, and have each gate connected to Vc, which acts as a first control signal. In this embodiment, the first reference voltage is typically connected to ground. i.e., Vp=0V. A complementary "push-pull" second control signal Vc′ is generated from Vc and is connected to the second reference voltage, i.e., Vg=Vc′. Thus, each gate comprising the series FET is connected to the second control signal Vc′ instead of being connected to Vg or ground, as in the first and second embodiments.

Varying the magnitude of the control signal Vc causes the conductance of the FETs to vary, thus varying the fractional amount of the input signal at the RF circuit input port that reaches the RF circuit output port. For the first and second embodiments the range of the control voltage Vc is $Vg \leqq Vc \leqq Vp$, where Vp is the first reference voltage and Vg is the second reference voltage. The first reference voltage Vp is unipolar and provides operating power to the present invention. In the third embodiment. $0 \geqq Vc \geqq Vx$ and $Vc' = Vx - Vc$, where Vx is the pinch off voltage of the FETs. Typically the pinch off voltage Vp of the FETs is about 3V, and $0 \leqq |Vc| \leqq |Vp|$.

A D.C. coupled circuit compensation means is connected in parallel with the series FET, while an A.C. coupled circuit compensation means is connected and in series with the shunt FETs. Together these circuit compensation means extend the attenuator frequency range while maintaining a substantially constant impedance at the RF circuit input and RF circuit output ports, and linearize attenuation control. An attenuator according to the present invention exhibits good attenuation linearity (i.e., linear change of attenuation with control voltage) and a desirable control signal range typically 0–3 VDC at about 5 mA. In the first and second preferred embodiments, the attenuation response is flat within about ±0.5 dB over approximately a 2–20 GHz bandwidth while exhibiting a dynamic range of greater than 10 dB. In those embodiments a capacitor in series with the RF circuit input port and RF circuit output port provides AC coupling, and isolates the DC bias levels within the attenuator circuit from any DC offset that might be present on the RF input signal or on the load. In the third embodiment, the attenuation is similarly flat over a bandwidth of approximately 0–20 GHz.

The bias means, control voltage means and circuit compensation means include well defined resistors which bias the FETs help define RF circuit input and RF circuit output port impedances, permit substantially linear attenuation control with a single control signal Vc and with inductive-capacitive components, extend the frequency response of the attenuator. However, the FET tolerances need not be well defined due to the inclusion of the circuit compensation means and it is sufficient if the turn-on and turn-off channel conductance tolerances of the FETs are controlled to within about ±30%. By contrast, the required tolerances for FETs used in prior art attenuators or amplifiers would have to be held within about ±10% to 15%.

It is an objective of the present invention to provide a microstripline MMIC attenuator with attenuation flat within about ±0.5 dB over approximately a 2–20 GHz bandwidth that operates from a single polarity power supply and is controlled by a single control signal in a reasonably linear manner.

It is also an objective of the present invention to provide a microstripline MMIC attenuator with attenuation flat within about ±0.5 dB over approximately a 0–20 GHz bandwidth.

It is a still further objective to provide an attenuator that exhibits a dynamic range of greater than 10 dB.

It is an additional objective to provide an attenuator with power handling characteristics in excess of 0.25 w.

It is also an objective to provide a multi-Schottky gate FET with increased power handling capability compared to a single-Schottky gate FET, but whose RF small signal characteristics are not significantly degraded compared to such a single gate FET.

Other features and advantages of the invention will appear from the following figures and from the following description, wherein several preferred embodiments are set forth in detail.

DETAILED DESCRIPTION OF THE PREFERRED EMBODIMENT

Figure 1:
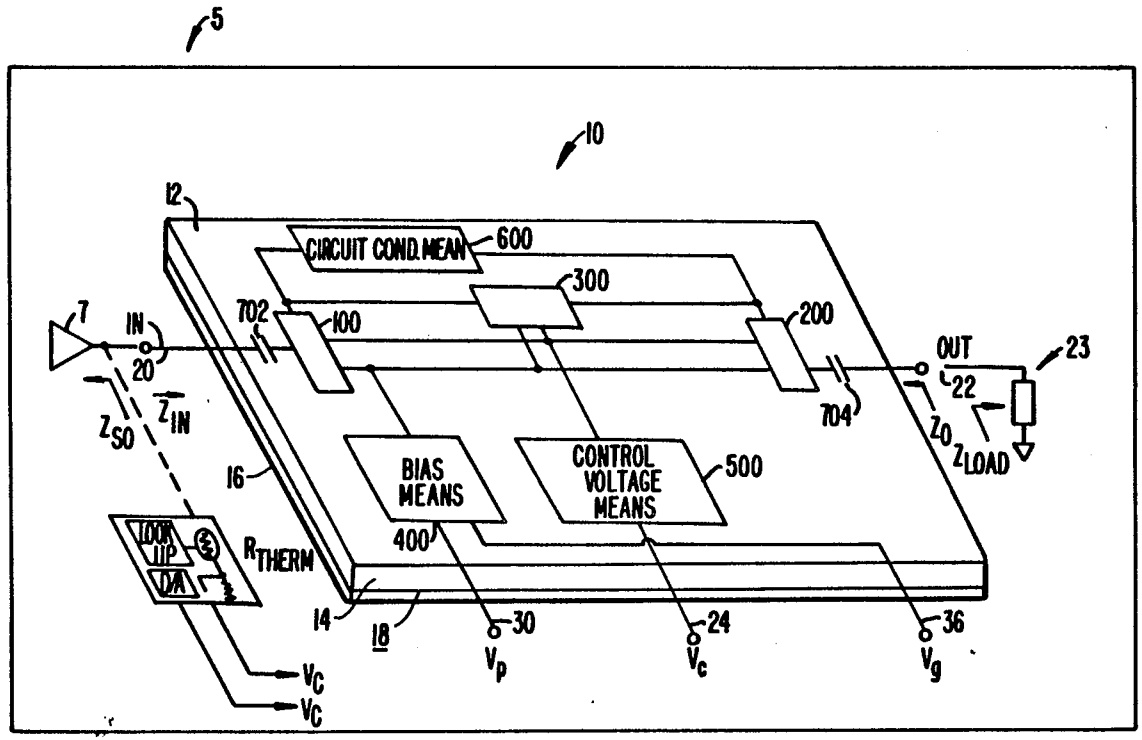
FIG. 1 is a block diagram showing the elements of an attenuator according to the present invention.

FIG. 1 shows in block diagram form a microstripline microwave system 5 that includes an amplifier 7 (or other source of RF-signals) and an attenuator 10 according to the present invention. Attenuator 10 is a microstripline FET MMIC attenuator constructed on a first surface 12 of a semi-insulating typically GaAs, substrate 14. A ground plane 16 is formed by metallizing the entire area of opposing surface 8.

An RF input signal to be attenuated is connected to the circuit Input Port 20 of attenuator 10, which circuit Input Port 20 has an input impedance Zin. Generally, the RF input signal is the output signal from a microwave amplifier 7 or other signal source (not shown) having a source output impedance Zso of typically 50 Ω. In the preferred embodiment, input impedance Zin is chosen to match the output impedance Zso of the amplifier 7 or other source providing the RF input signal to circuit Input Port 20. Attenuator 10 permits a fraction (i.e. the attenuated portion) of the RF signal present at the circuit Input Port 20 to appear at the circuit Output Port 22. A load 23 having an input impedance Zload of typically 50 Ω is connected to the circuit Output Port 22, which exhibits an output impedance Zout that is chosen to match the Zload. In the preferred embodiments, Zin and Zout are each about 50 Ω.

The fractional amount of signal from the circuit Input Port 20 that is permitted to reach the circuit Output Port 22 is determined by the magnitude of a control signal, Vc connected to attenuator 10 at Control Port 24. In the preferred embodiments, the fraction of the signal present at circuit Input Port 20 that is allowed to appear at circuit Output Port 22 varies from about 1 dB (the insertion loss of attenuator 10 at minimum attenuation) to about 14 dB (i.e., the maximum attenuation). A variable source provides Vc at port 24.

Amplifier 7 typically exhibits low gain at elevated temperature and excess gain at low temperature. Therefore a microwave system incorporating amplifier 7 would have improved gain characteristics if a greater degree of attenuation could be inserted into the system at low temperatures than at high temperatures. As suggested by FIG. 1, a network such as resistor-thermistor network $R_{therm}$ mounted near amplifier 7 could generate a control voltage Vc having a desired voltage versus temperature characteristic to cause attenuator 10 to insert a controlled attenuation to compensate for temperature changes. Alternatively, if network $R_{them}$ senses signal frequency as well as temperature and also includes a "look-up" table of the temperature-frequency-gain characteristics of amplifier 7, an output of a "look-up" table can be connected to a D/A converter to generate a control voltage Vc suitable for compensating gain versus temperature and frequency characteristics of amplifier 7.

A first Reference Port 30 is connected to a first source of reference voltage. Vp (not shown). A Second Reference Port 36 is connected to a second source of reference voltage Vg (not shown). typically ground. The first reference voltage Vp is made equal to the common pinch-off voltage of the FETs in attenuator 10, typically 3V. and the range of control voltage Vc is $Vg \leqq Vc \leqq Vp$.

Attenuator 10 is composed of active variable conductance devices 100, 200 and 300, and a number of passive elements including Bias Means 400. Control Voltage Means 500 and Circuit Compensation Means 600. The first and second preferred embodiments include AC coupling means 702 and 704 connected respectively between the RF circuit input port 20, the RF circuit output port 22 and the attenuator 10.

Active devices 100, 200 and 300 are microwave frequency depletion mode field effect transistors (FETs) with one or more Schottky gates (or control leads). The gates in these FETs are each about 0.5 $\mu$ long. FETs 100 and 200 are connected as shunt devices, while FET 300 is connected as a series device. FETs 100, 200 and 300 are computer modelled and fabricated for use in the present invention. Although output leads on the FETs are denoted as drain or source in the following description, it is to be understood that the FETs are symmetrical and drain and source connections (i.e., output leads) may be interchanged with one another.

As indicated in FIG. 1, the Bias Means 400 and Control Voltage Means 500 are connected with each FET 100, 200 and 300, while the Circuit Compensation Means 600 is connected with FETs 100 and 200 and in parallel with FET 300. The control signal Vc present at Control Port 24 reaches FETs 100, 200, 300 via the Control Voltage Means 500. The conductance of each FET. and thus the attenuation of attenuator 10, is determined by the magnitude of the control signal Vc.

Figure 2:
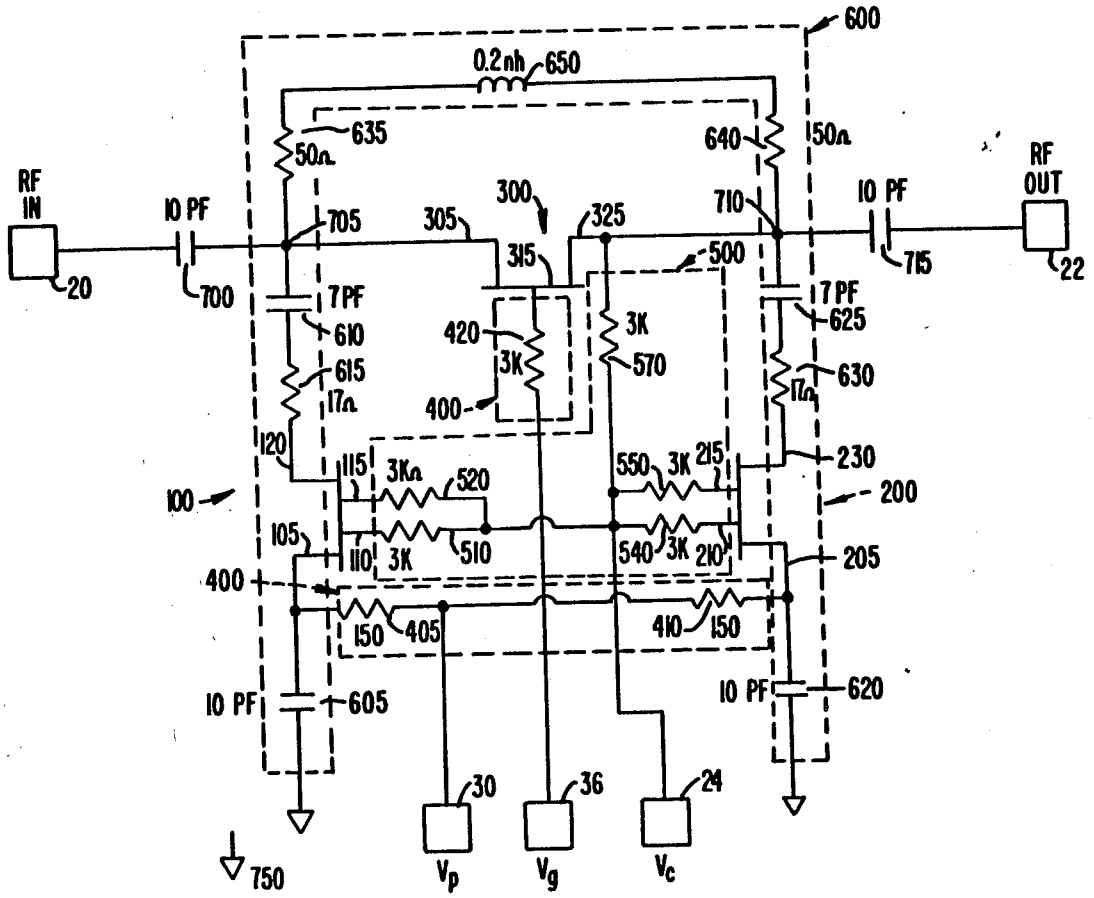
FIG. 2 is a schematic of a first embodiment of a attenuator according to the present invention.

With reference to FIG. 2 a schematic of a first preferred embodiment of the present invention is shown. It is to be understood that the attenuator circuit of FIG. 2 as well as the other preferred embodiments is fabricated on a first surface 12 of the substrate 14 shown in FIG. 1.

Comparing FIG. 2 with FIG. 1 it is seen that an RF input signal (not shown) is connected to circuit Input Port 20 and that a capacitor 700 is connected between Port 20 and node 705. Capacitor 700 protects whatever DC level is present at node 705 from whatever DC level might be present on the RF input signal. At the output side of the circuit capacitor 715 is connected between node 710 and circuit Output Port 22 and protects whatever DC level might be present at node 710 from any DC level present across the load. Capacitors 700 and 715 are each typically about 10 pF.

A first shunt FET 100 is connected between node 705 and ground, 750, a second shunt FFT 200 is connected between node 710 and ground 750, while a series FET 300 is connected between nodes 705 and 710 with drain 305 connected to node 705 and with source 325 connected to node 710.

Bias Means 400 includes resistors 405, 410, and 420 which are connected to FETs 100, 200 and 300 as follows. Resistor 405 is connected between source 105 of FET 100, and the first voltage reference Vp at the First Reference Port 30, and resistor 410 is similarly connected between Vp and source 205 of FET 200. Resistor 420 connects gate 315 of FET 300 and the second voltage reference Vg at the Second Reference Port 36. Resistors 405 and 410 are each about 150 Ω, and resistor 420 is about 3 KΩ

In the embodiment shown in FIG. 2, the first reference Vp is made equal to the positive value of the pinch-off voltages of FETs 100, 200, 300, typically about 3V, while Vg is typically connected to ground 750. The attenuator shown in FIG. 2 operates from a single polarity power source, namely the source of the first reference voltage Vp. It is understood that the first voltage reference Vp is measured with respect to the second voltage reference Vg.

Voltage Control Means 500 includes resistors 510, 520 which are connected respectively, between gates 110, 115 of FET 100 and the control signal Vc at Control Port 24 resistors 540, 550 which are connected respectively, between gates 210, 215 of FET 200 and Vc at port 24, and resistor 570 which is connected oftween source 325 of FET 300 (which source is also connected with node 710) and Vc at port 24. In the embodiment of FIG. 2. resistors 510, 520, 540, 550 and 570 are each about 3KΩ.

Applicant has discovered that connecting resistor 570 between the source 325 of the series FET 300 and Vc allows the attenuation of the embodiment of FIG. 2 to be controlled by a single control voltage Vc, with the more conventional connections between Vc and the gates to the shunt FETs 100 and 200. Once the advantage of the resistor 570 connection is realized, computer analysis and modeling of the circuit of FIG. 2 permits specification of the various components and specification of the FET characteristics.

Figure 3A:
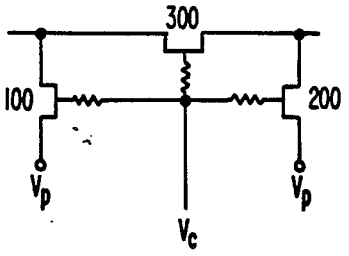
FIGS. 3A–3C demonstrate the evolution of the single control voltage circuit of FIG. 2.
Figure 3B:
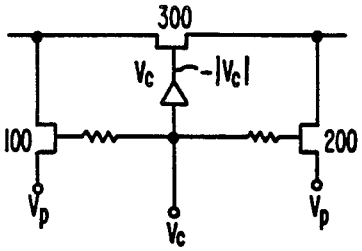
Figure 3C:
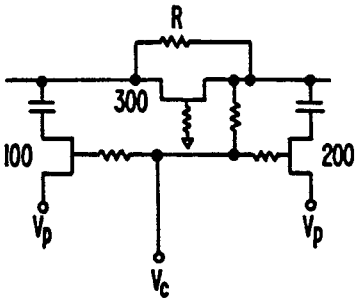

The circuit of FIG. 2 is unusual in that the control voltage Vc is presented to an output lead of transistor 300. Conventional wisdom is that a control voltage is presented to an input lead (i.e., a gate lead) of a FET. FIGS. 3A–3C demonstrate the difference between the single control voltage circuit of FIG. 2 and other configurations that may have been attempted in the prior art.

The chart accompanying FIG. 3A demonstrates that connecting the same control voltage Vc to the gate of each FET 100, 200, 300 will not work. For instance, when Vc=Vp, FETs 100 and 200 are on because they are depletion mode devices with the same potential Vp at gate and source. Because FETs 100 and 200 are on, each output lead of FET 300 is connected to Vp via FETs 100 and 200. But since the gate of FET 300 is also at Vp, FET 300 is on. Clearly then the abbreviated circuit of FIG. 3A will not function because all the FETs turn on when Vc=Vp.

As the accompanying chart demonstrates, the circuit of FIG. 3B grounds the sources of FETs 100 and 200 and controls attenuation with a single control voltage Vc assuming that additional circuitry for generating the complementary "push-pull" control voltage Vc is provided. While the circuit of FIG. 3C will vary attenuation as a function of Vc the ability to linearize the attenuation transfer function is quite limited. Further, the requirement for "push-pull" circuitry increases the complexity of the bias circuit. Not only does "push-pull" circuitry require dual polarity power supplies, but the "push-pull" amplifier consumes quiescent D.C. current. By contrast, the present invention consumes substantially no D.C. current.

The circuit of FIG. 3C represents the circuit of FIG. 2. As shown by the chart accompanying FIG. 3C when Vc=0V. transistors 100 and 200 are reverse biased and therefor off, and transistor 300 is on because it has the same potential at gate and source. Further, when Vc=Vp, FETs 100 and 200 are on but FET 300 is reverse biased and is off. In summary, the abbreviated circuit of FIG. 3C controls attenuation without requiring a complementary push-pull control voltage. Further, including a shunt resistor R across FET 300 allows linearization of the attenuation transfer function.

Circuit Compensation Means 600 includes the remaining components shown schematically in FIG. 2 which form D.C. and A.C. conducting, frequency dependent circuits. Resistor 635, inductance 650 and resistor 640 are connected in series between nodes 705 and 710. i.e., in parallel across FET 300 to form a frequency dependent D.C. conductive circuit that shunts the output leads 305, 325 of the series FET 300. In the embodiment shown, resistors 635 and 640 are each about 50 Ω while inductance 650 is about 0.2 nH. Capacitors 605, 610 and resistor 615 form a first A.C. coupled frequency sensitive circuit in series with the output leads 105, 120 of FET 100, while components 620, 625 and 630 form a second similar circuit with respect to FET 200. More specifically, capacitor 605 is connected between source 105 of FET 100 and ground 750, placing source 105 at RF ground potential. Similarly capacitor 620 is connected between source 205 of FET 200 and ground 750. Capacitor 610 and resistor 615 are connected in series between drain 120 of FET 100 and node 705 and similarly capacitor 625 and resistor 630 are connected in series between drain 230 of FET 200 and node 710. In the embodiment shown, resistors 615 and 630 each about 17 Ω, capacitors 605 and 620 are each about 10 pF, while capacitors 610 and 625 are each about 7 pF. Capacitors 610 and 625 serve to decouple FETs 100 and 200 from any potential present at nodes 705 and 710, respectively, thereby facilitating attenuation control with the single control voltage Vc. Resistors 615 and 630 contribute to a substantially constant input impedance at node 705 and a substantially constant output impedance at node 710, respectively, and further contribute to linearizing attenuation as a function of the single control voltage Vc.

In the embodiment of FIG. 2, inductance 650, resistors 615, 630, 635, 640 capacitors 605, 610, 620, 625 are chosen such that, together with the intrinsic lead inductance and shunt capacitance associated with FETs 100, 200 and 300, the following criteria are met:

(1) The attenuation transfer function from the RF circuit input port 20 to the RF circuit output port 22 changes substantially linearly as a function of the magnitude of the single control voltage Vc at port 24;

(2) The series resonant frequency of the attenuator circuit measured from node 705 to 710 is substantially the same as the shunt resonant frequency measured from node 705 to ground 750, or from node 710 to ground 750, thereby extending the higher frequency performance of the attenuator; and (3) Nominal Zin across RF circuit input port 20 and nominal Zout across RF circuit output port 22 are substantially constant throughout the frequency range of interest (about 2 GHz to 20 GHz for the first embodiment shown). substantially constant throughout the frequency range of interest typically about Ω.

Realization of the desired transfer function characteristics for an attenuator according to the present invention requires an accurate analysis and synthesis of the equivalent circuit for the circuit shown in FIG. 2. Applicant has performed computer analyses and optimizations on the embodiment shown in FIG. 2, and the other embodiments as well, using the microwave simulation software known as "SUPER-COMPACT". Such software and its use in analyzing or synthesizing circuits is known in the art, and the analysis will not be described in detail.

A brief overview of the design trade-offs that must be considered in the analysis and design of the present invention will now be given. With reference to FIG. 2 as a first approximation, the input impedance of the circuit should be about the impedance of resistor 615 plus the on conductance of FET 100. For example, if 50 Ω input impedance is desired, resistor 615 should be in the tens of ohms. If resistor 615 is too large (say 45 Ω) it will be difficult to fabricate FET 100 with a 5Ω on resistance capable of operating at microwave frequency and meeting other circuit restraints. A value of resistor 615 of about 17Ω allows realization of FET 100 with an acceptable gate width of about 40μ, the gate length of all FET gates being about 0.5μ.

With reference to FIG. 2, the geometry of FETs 100, 200 and 300 is selected and optimized to produce the desired 2–14 dB attenuation dynamic range to produce the desired ±1 dB attenuation flatness over the operating frequency to linearize the attenuation-versus-control voltage transfer function, and to maintain good input and output impedance matching to the source and load such that the VSWR≦2:1 over the entire frequency and dynamic attenuation range.

For example, varying the gate width of the shunt FETs 100, 200 will primarily affect the circuit dynamic range, the linearity of the transfer function and the impedance matching. Varying the gate width on the series FET 300 primarily affects the attenuation flatness the transfer function linearity and the impedance matching. After initially approximating the FET geometry, the passive components are approximated. As noted, the value of resistors 615, 630 are dependent upon the on resistance of FETs 100, 200. The value of resistors 635, 640 affects the circuit dynamic range: increasing these resistors will provide increased attenuation. Inductance 650 is chosen to resonant with the capacitance associated with series FET 300. The capacitors shown in FIG. 2 are chosen to block D.C. Their values are not too critical providing the capacitances are not so large as to contribute undesired parasitics to the circuit.

Figure 4A:
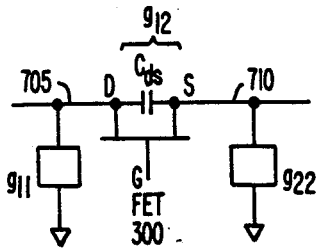
FIGS. 4A–4F demonstrate design trade-offs used in arriving at the embodiment of FIG. 2.

FIGS. 4A–4F provide further insight into the design trade-offs that must be considered. FIG. 4A is a simplified schematic of a series FET, say FET 300 of FIG. 2 connected in series between nodes 705 and 710. FET 300 has a drain D, a source S and a gate G. Everything that the source S "sees" is denoted as an equivalent shunt impedance, g11, and everything that drain D "sees" is denoted as equivalent shunt impedance g22. Thus g11 and g22 include the effect of discrete stray and parasitic components. The effective drain-source conductance of the FET alone, g12 includes the effect of parasitic drain-source capacitance Cds as shown.

Figure 4B:
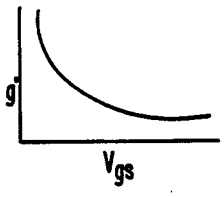
Figure 4C:
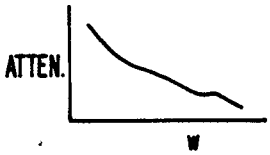

FIG. 4B is a plot of the effective conductance g of the FET (i.e., conductance g12 in parallel with the effective conductance seen by the FET) versus the gate-source potential of the FET. Not surprisingly, the curve is nonlinear. Because capacitance Cds allows higher frequency signals to pass freely from node 705 to node 710, the attenuation from node 705 to node 710 deteriorates at higher frequency as shown by FIG. 4C.

Figure 4D:
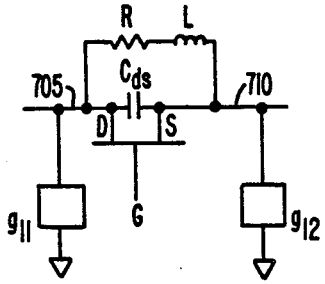
Figure 4E:
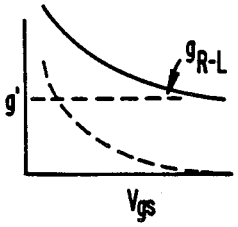

Consider now the addition of a series resistance R and inductance L connected in parallel across the drain source of FET 300, as shown in FIG. 4D. FIG. 4E shows in dashed lines the same non-linear g′ curve shown in FIG. 4B. Also shown in FIG. 4E is an essentially horizontal dashed line denoted gR-L representing the equivalent parallel conductance of the series resistance-inductance R and L. The gR-L conductance is essentially horizontal because the conductance contribution from R and L is essentially independent of the voltage Vgs. If the non-linear curve and the horizontal line are added (since all contributing conductances are in parallel), as shown in FIG. 4E the ratio of g at minimum Vgs and maximum Vgs will be greatly reduced. Thus, judicious choice of R and L can adjust the g′ ratios and linearize the function of the gate-source control voltage. Those skilled in the art will appreciate that by proper scaling of R and L, taking into account the intrinsic parameters of FET 300 as well as the effective conductance provided by the remainder of the circuit, the g′ versus Vgs curve of FIG. 4E can be made reasonably linear, non-linear or some shape in between.

Figure 4F:
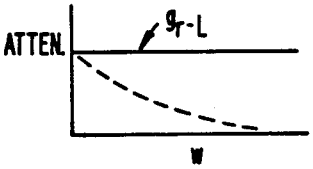

FIG. 4F shows that the presence of the shunt inductance L improves attenuation at higher frequencies. Although the beneficial effect of L can be seen in a pole zero analysis, it is intuitive that while Cds by itself deteriorates attenuation at high frequency, L by itself will improve attenuation at high frequency, and that at a resonant frequency, the effects of L and Cds will cancel each other out.

Returning to FIG. 2, once the parameters of FETs 100, 200 and 300 are known over the frequency range of interest the resistors, capacitors and inductance 650 comprising the remainder of the circuit are selected to meet the Zin, Zout and other design criteria. When necessary. FETs 100, 200 and 300 are scaled and fabricated to exhibit the characteristics required by the circuit of FIG. 2.

Applicant has discovered that the power dissipation of a FET, and therefore of an attenuator according to the present invention may be increased by increasing the number of gates and the gate width in comparison to a single-gate FET such that the gate width is increased by N where N equals the number of gates. I.e., if two gates are fabricated the gate width should about double; if three gates are fabricated, the gate width should about triple; etc. Applicant has found that multi-gate FETs so constructed are capable of increased power dissipation without significant degradation of the multi-gate FET's higher frequency characteristics when compared to the small signal RF characteristics of a single gate FET. Traditionally, power dissipation in a FET was increased by increasing the size of the FET. However, while increased FET geometry increases FET power dissipation, undesired shunt capacitance also increases, degrading FET performance at higher frequencies. Furthermore, at higher power levels signal amplitudes increase and FETs tend to break down from drain to gate because of the relatively large voltage signals present. The multi-gate FETs 100 and 200 employed according to the present invention avoid increased shunt capacitance and drain-gate breakdown by increasing the gate width as described. By maintaining the ratio of increased FET gate width size to number of gates substantially constant multi-gate FETs according to the present invention do not have substantially increased shunt capacitance when compared to single gate FETs and permit increased dissipation without significant degradation at higher frequencies. FIGS. 5A–5I illustrate the advantages provided by the above-described multi-gate FETs.

Figure 5A:
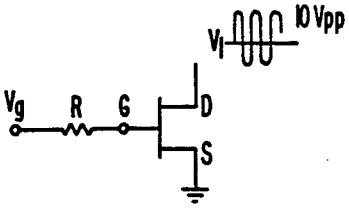
FIGS. 5A–5I demonstrate the advantages of multi-gate FETs according to the present invention.

FIG. 5A shows a single gate FET with a bias resistor R connected to gate G, and with a drain D and a grounded source S. Assume the FET has a nominal gate length of 0.5 $\mu$, a gate width W1 and maximum voltage and current handling capability of V1, I1, respectively. It is important to note that the gate width extends in a plane perpendicular to the page upon which the figures are drawn.

Figure 5B:
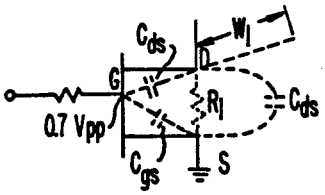

FIG. 5B shows the node voltage distribution at microwave frequencies assuming that microwave signals of say 10 Vpeak-peak (10 Vpp) is applied to the drain D of the FET shown in FIG. 5A. At RF frequencies the RF bias at gate G will be about one Schottky diode drop (about 0.7V) greater than the potential at the corresponding source S. Since the S is grounded. RF potential at S is 0 Vpp. The RF bias at gate G is about 0.7 Vpp. If the FET had a drain-gate breakdown voltage of 5V. the resultant 9.3 Vpp drain-gate potential would damage the FET.

Figure 5C:
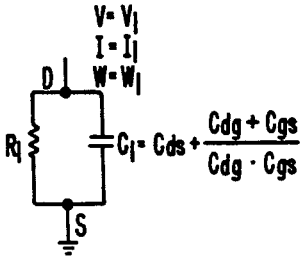

As shown by FIG. 5C. the equivalent circuit may be represented by a two terminal circuit having a resistor R1 in parallel with a capacitance C1. Since bias resistor R is relatively large (3KΩ) compared to the channel conductance R1 and associated capacitance C1 the external gate terminal G and gate bias resistor R may be ignored. The capacitance C1 approximates the parallel combination of Cds (the drain-source capacitance) and the series combination of Cdg and Cgs (the drain-gate and gate-source) capacitance of the FET.

Figure 5D:
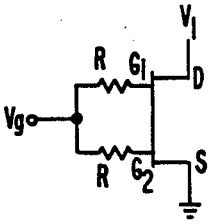
Figure 5E:
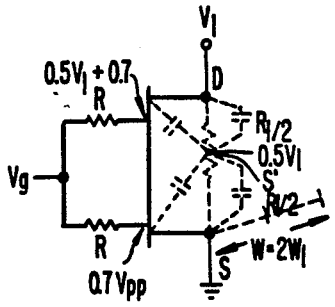
Figure 5F:
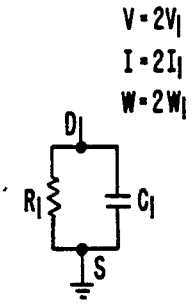

FIGS. 5D–5F demonstrate the advantage provided by a dual-gate Schottky FET according to the present invention. FIG. 5D shows a dual-gate FET similar to say FET 100 or 200 in FIG. 2. The FET in FIG. 5D has two gates G1 and G2 a source S and a drain D. Each gate G1, G2 is connected through a resistor R to a bias potential Vg. Source S is grounded and an RF microwave signal of say 10 Vpeak-peak (10 Vpp) is applied to drain D. The device size of the FET in FIG. 5D is increased to 2 WI, or twice the gate width of the single gate FET shown in FIG. 5A. Since the gate width has been doubled the maximum current capability doubles to 211, and the voltage across the drain may also be safely doubled (as will be explained shortly). Thus, the power capability of the dual-gate FET is quadrupled over the single-gate FET of FIG. 5A. However, the equivalent circuit shown in FIG. 5F is substantially the same as that of the single-gate FET shown in FIG. 5A because of the manner in which the dual-gate FET is scaled by maintaining the ratio of gate width to the number of gates substantially the same as that of the single-gate FET.

FIG. 5E shows the FET of FIG. 5D at RF microwave frequencies. At DC. each gate has the same bias because each gate is connected to Vg. However, at RF microwave frequencies. At DC, each gate will self-bias, as will now be described. The 10 Vpp signal present at drain D will distribute itself linearly over an internal bulk resistance $R_1$ extending across the FET channel from drain D to source S.

Internal to the FET, a small intrinsic series capacitor C is present between the internal gates G1, G2 (which are connected through the FET package to external gates G1, G2) and the corresponding regions S, S1 of the channel extending from drain D to source S. As a result, the two-gate FET shown acts as though it had two sources, external source S and an internal source S'. The voltage at source S is zero (i.e. ground) and the voltage at internal source S' is 5 Vpp, since S may be thought of as being midway across $R_1$. Thus, the RF potential from drain D to source S is dissipated over two equal channel regions, extending from D to S', and from S' to S, improving FET voltage breakdown and power dissipation.

At RF frequencies, the RF bias at each internal gate G1 G2 will be about one Schottky diode drop (0.7V) greater than the potential at the corresponding source S, S1. Thus, since the RF potential at S=0 Vpp the RF bias at G1=0.7Vpp. Since the RF potential at S1=5 Vpp the RF bias at G2=5.7 Vpp. If the FET had a drain-gate breakdown voltage of 5V, and had only one gate, the RF gate bias would be 0.7 Vpp, and the resultant 9.3 Vpp drain-gate potential would damage the FET. However, as shown, where the FET has two gates, the drain-gate potential does not exceed 4.3 Vpp and no damage results. Conversely, the maximum drain-source voltage $V_1$ may be doubled compared to the FET of FIG. 5A without breakdown occurring.

Figure 5G:
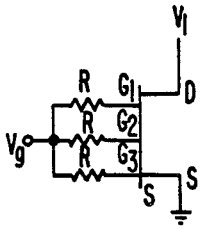

Assume now that the FET has three gates as shown in FIG. 5G the device size is increased to a gate width of 3 W1 and that 10 Vpp is again applied at the drain D.

Figure 5H:
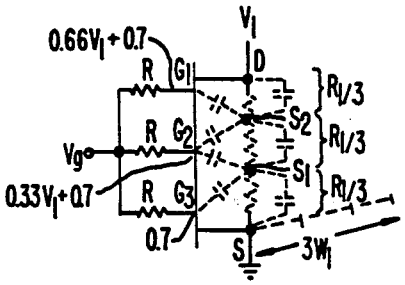
Figure 5I:
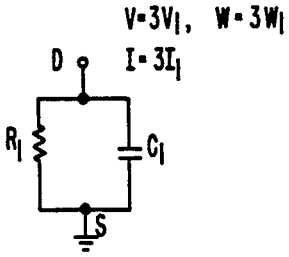

With three gates, the 10 Vpp potential will distribute across the drain-source channel and three effective sources will be present: S, S1 and S2 as shown in FIG. 5H. The RF voltage at the sources will be: S=0 Vpp, S1=3.33 Vpp and S2=6.66 Vpp. Thus, in a three-gate FET the power will be distributed equally in three regions in the FET channel. Since the bias at each internal gate G1 G2', G3' will be about 0.7V greater than the corresponding source potentials, G1' will self bias at 0.7 Vpp. G2' will bias at 4 Vpp and G3 will bias at 7.3 Vpp. The drain-gate potential is now reduced to 2.7 Vpp as compared with 4.3 Vpp for a two-gate FET, and compared with 9.3 Vpp for a single gate FET. Put another way, the triple gate FET of FIG. 5B could sustain about three times the drain-source voltage as the FET of FIG. 5A without drain-gate breakdown.

Although the foregoing description was in reference to multiple gate Schottky FETs, the same principle is equally applicable to multiple gate MOSFETs (metal on silicon FETs) or to multiple gate JFETs (junction FETs).

Returning now to FIG. 2 the circuit operates as follows. Each FET 100, 200, 300 has a pinch-off voltage of about 3V. The first reference voltage Vp applied to port 30 is made equal to the pinch-off voltage. In this case 3V, and the magnitude of the control signal Vc applied at port 24 will vary between 0V and 3V. It is assumed that the potential Vg applied at port 36 is the same ground as is present at points 750 in the circuit, i.e., Vg=0V.

When the magnitude of the control signal Vc=0, the DC potential between gate 315 and source 325 of series FET 300 is zero since the potential Vg at port 36 is also zero. Since FET 300 is a depletion mode device. FET 300 will be in a conducting state (i.e., minimum drain 305 to source 325 impedance, or maximum conductance). However, when Vc=0 shunt FETs 100 and 200 are each in the off or non-conducting state (i.e., maximum drain 120 to source 105, drain 230 to source 205 impedance, or minimum conductance) because the potential at each gate 110, 115 to source 105, and from each gate 210, 215 to source 205 is −Vp. Thus, Vc=0 corresponds to minimum attenuation through the present invention. The minimum attenuation at Vc=0 represents the insertion loss for the attenuator, and in the embodiment of FIG. 2 minimum attenuation or insertion loss, is less than 2 db over 2–20 GHz.

Consider now the situation when the control voltage Vc is increased to 3V. Series FET 300 will now be in the off or non-conducting state (i.e., maximum drain 305-source 325 impedance or minimum conductance) because the DC potential from gate 315 to source 325 is 3V. However, with Vc=3V. shunt FETs 100 and 200 are now in the on or conducting state because the potential from each gate 110, 115 to source 105 and each gate 210, 215 to source 205 is zero since the potential at port 24 equals the potential at port 30, namely 3V. Thus, when Vc=Vp, the circuit of FIG. 2 is in the maximum attenuating state typically about 14 dB.

At values $0 \leqq Vc \leqq 3V$ or, more generically, $Vg \leqq Vc \leqq Vp$ the attenuation resulting from the circuit of FIG. 2 will vary between a minimum attenuation of about 2 dB (i.e., the insertion loss) and a maximum attenuation of about 14 dB over 2–20 GHz. The configuration of FIG. 2 provides attenuation flatness within about 1.0 dB over about 2–20 GHz attenuation being controlled by the single control signal Vc.

Power handling calculations showed that a single-gate FET was sufficient for FET 300 but that the shunt FETs 100 200 required multi-gate FETs according to the present invention for increased dissipation. It is clear from FIG. 2 that when the series FET 300 is on, the relatively small on resistance of FET 300 compared to the typically 50 Ω load connected to port 22 means that the load will dissipate most of the power with relatively little power dissipation being required of FET 300. However, when the shunt FETs 100, 200 are on, the typically 33Ω on resistance of the FETs when compared to the typically 17Ω impedance of resistors 615, 630 means that the FETs will dissipate considerable power. Therefore in the embodiment of FIG. 2 a single-gate device is used for the series FET 300 while dual-gate devices are used for the shunt FETs 100, 200. The dual-gate devices have a gate width about twice a single gate device as described above with reference to FIGS. 5A–5F. The attenuator circuit of FIG. 2 can handle about 30 mW of RF power at the RF circuit input port 20 over a 2–20 GHz frequency range. Other characteristics of the attenuator of FIG. 2 are listed in FIG. 17.

Figure 6:
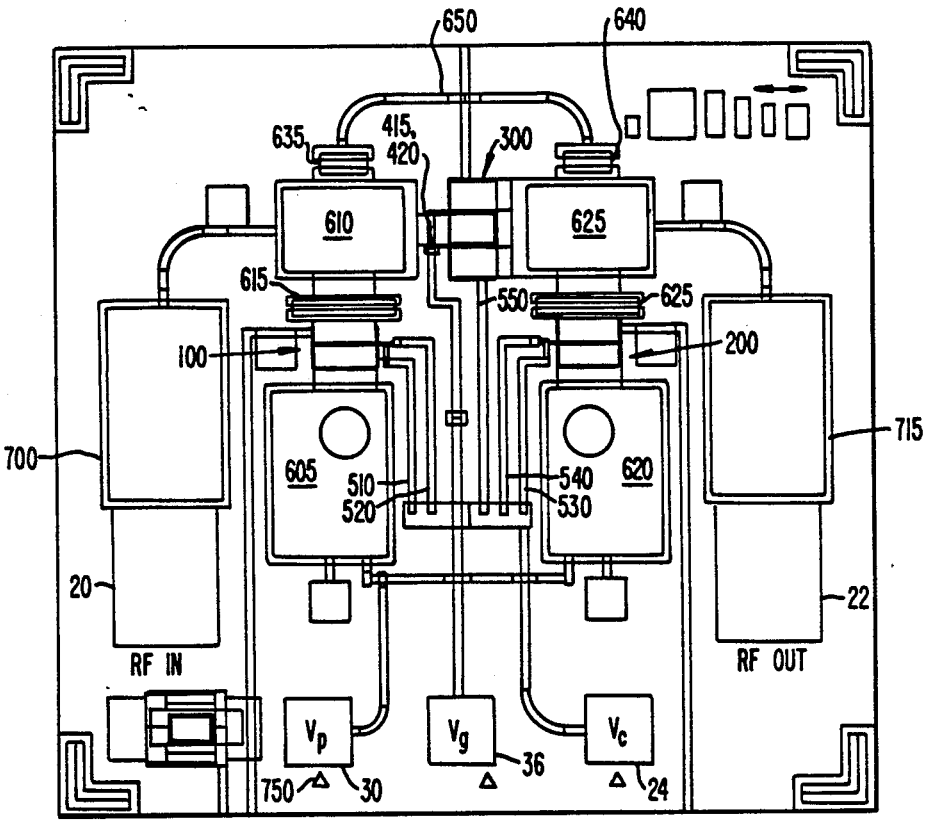
FIG. 6 is a plan view of an MMIC chip showing the components of the attenuator of FIG. 2.

FIG. 6 is an IC layout plan view of an attenuator according to the present invention as shown in FIG. 2. The dimensions of the IC chip shown in FIG. 6 are about 1.4 mm×1.4 mm. In FIG. 6, the size of each gate in FETs 100 and 200 is about 0.5μ long by about 80μ wide, and the size of each gate in FET 300 is about 0.5μ long by about 150μ wide. In the embodiment of FIG. 2 the bottom connections to capacitors 605, 620 are connected to ground through a via hole to accommodate the 2–20 GHz frequency range of interest.

Figure 7:
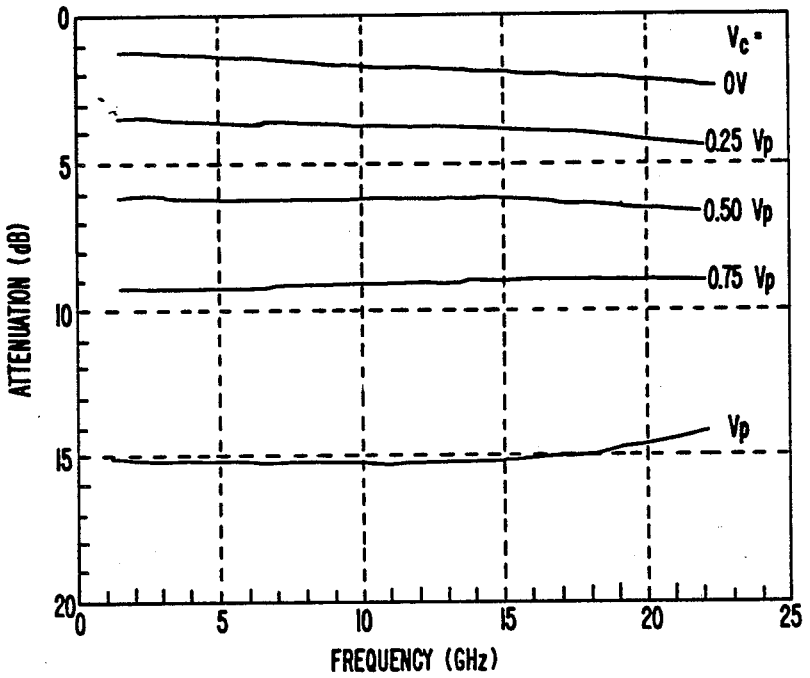
FIG. 7 is a plot of projected attenuation versus frequency for the attenuator of FIG. 2.
Figure 8:
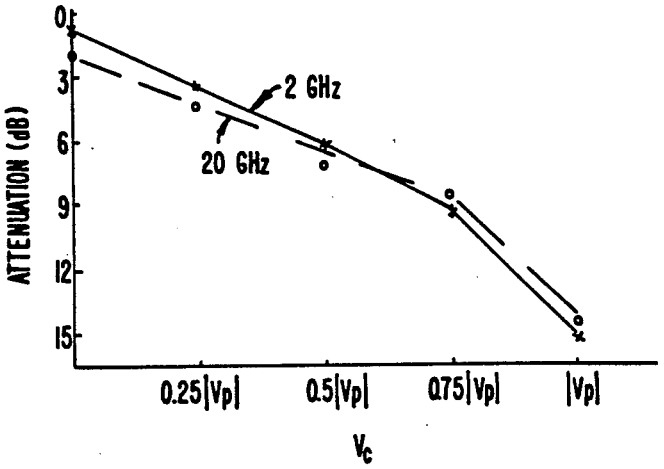
FIG. 8 is a plot of projected attenuation versus control signal magnitude for the attenuator of FIG. 2.

As shown by FIG. 7, the anticipated or projected attenuation versus frequency characteristics of the attenuator of FIG. 2 are superior to what is known in the art. Similarly, as shown in FIG. 8, the projected attenuation versus Vc characteristic of the present invention exhibits non-critical and reasonably linear control.

Figure 9:
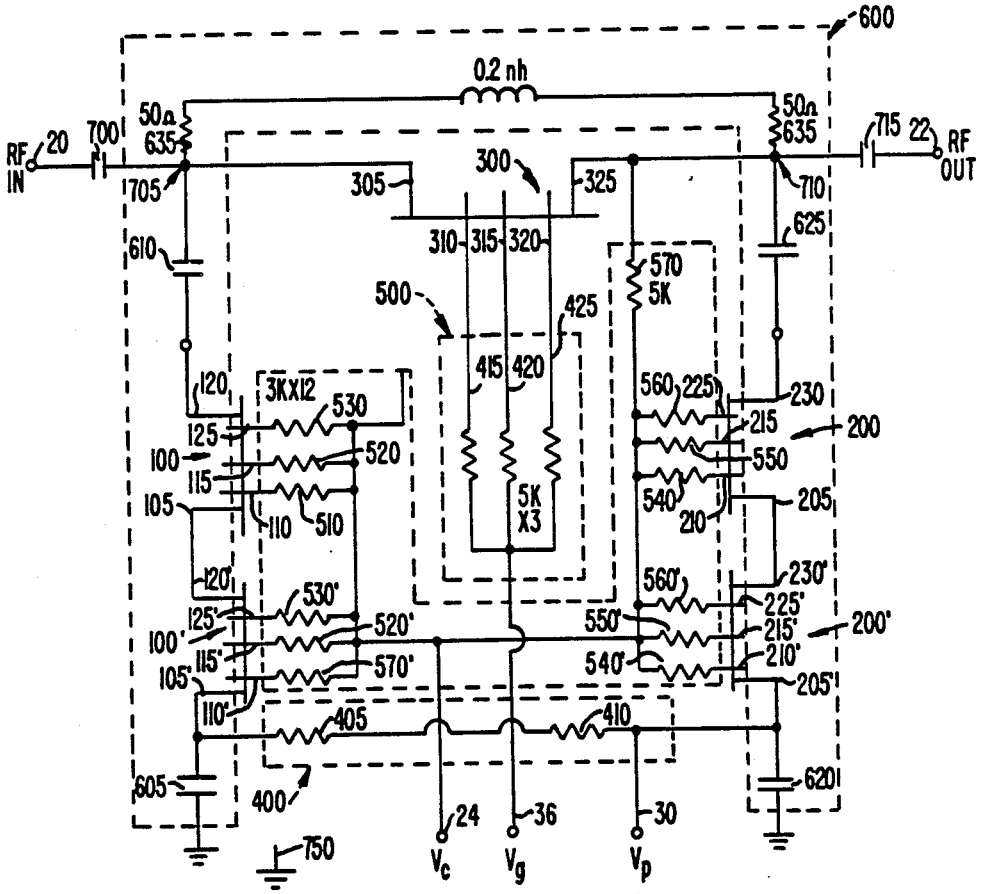
FIG. 9 is a schematic of a second embodiment of an attenuator according to the present invention.

With reference to FIG. 9, a second preferred embodiment is shown wherein the series FET 300 of FIG. 2 has been replaced with a triple gate FET, and wherein each shunt FET 100, 200 of FIG. 2 has been replaced with two series-connected triple gate FETs 100, 100′ and 200, 200′ to accommodate increased power dissipation. The gate width of the triple-gate FET 300 is about triple the width of the single gate in FET 300 in FIG. 2, for the reasons described in reference to FIGS. 5A–5I. A comparison of the circuit of FIG. 9 with that of FIG. 2 shows that the two circuits are very similar, with higher power triple gate FETs 100, 100′, 200, 200′ and 300 being used. Resistors 615 630 present in the embodiment of FIG. 2, are eliminated in the embodiment of FIG. 9 as computer analysis of devices 100, 100′, 200, 200′ and 300 reveals that discrete resistors are not required. The circuit of FIG. 9 can handle about 250 mW of RF power at the RF circuit input port 20, over a 2–20 GHz frequency range.

Figure 10:
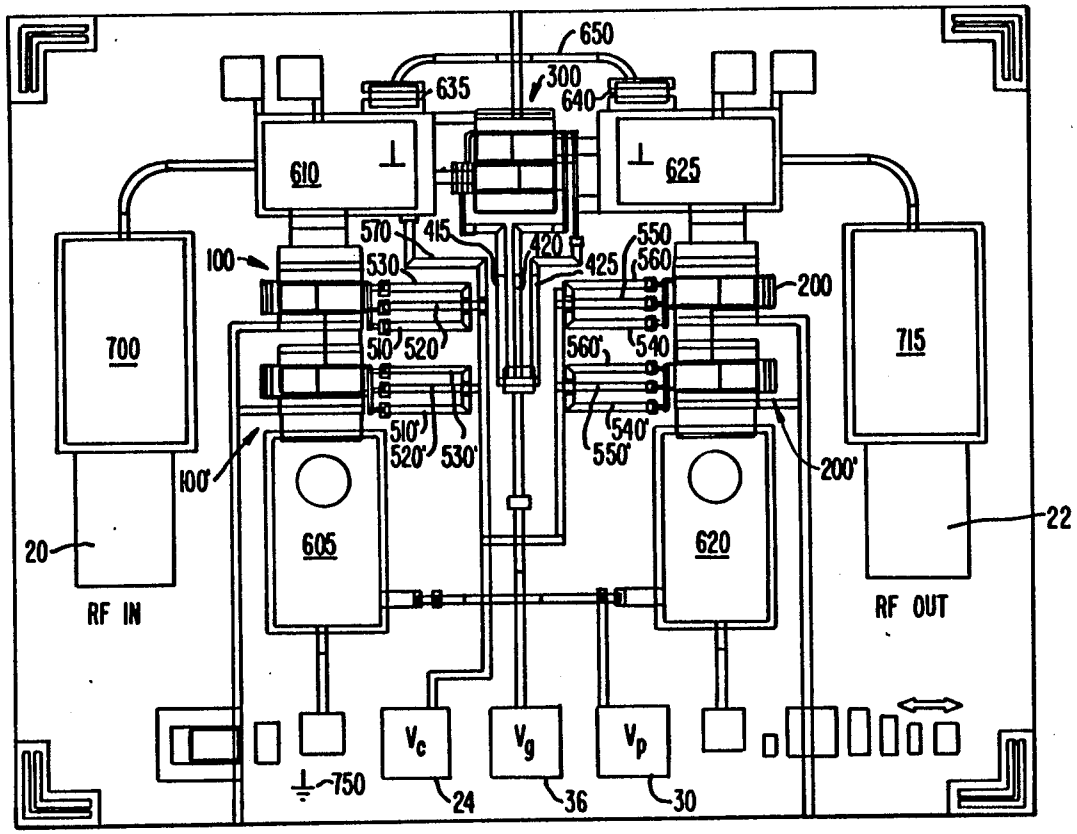
FIG. 10 is a plan view of an MMIC chip showing the components of the attenuator of FIG. 9.
Figure 11:
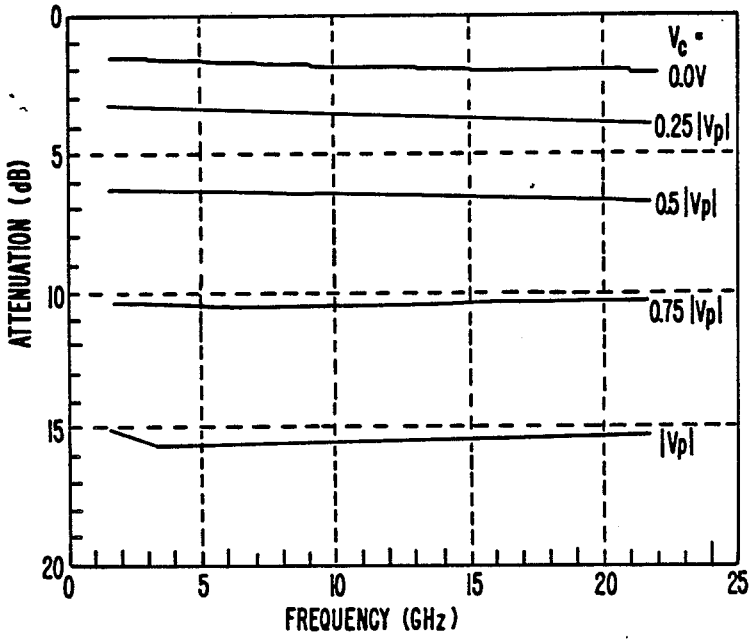
FIG. 11 is a plot of projected attenuation versus frequency for the attenuator of FIG. 9.
Figure 12:
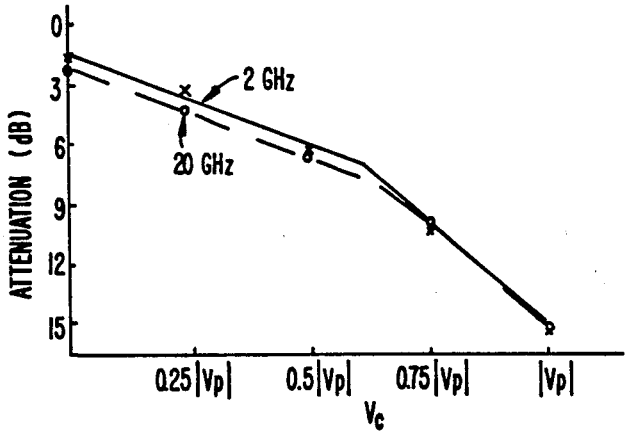
FIG. 12 is a plot of projected attenuation versus control signal magnitude for the attenuator of FIG. 9.

FIG. 10 is a plan view of an MMIC chip embodying an attenuator according to FIG. 9. The chip size shown in FIG. 10 is about 1.4 mm×1.5 mm. In FIG. 10 each gate in the tri-gate FETs 100, 100′, 200, 200 is about 0.5μ long by about 240 μ wide, and each gate in FET 300 is about 0.5μ long by about 360μ wide. FIGS. 11 and 12 show the projected attenuation versus frequency and attenuation versus control signal characteristics of the circuit of FIG. 9, while FIG. 17 demonstrates other anticipated characteristics of this second embodiment.

Figure 13:
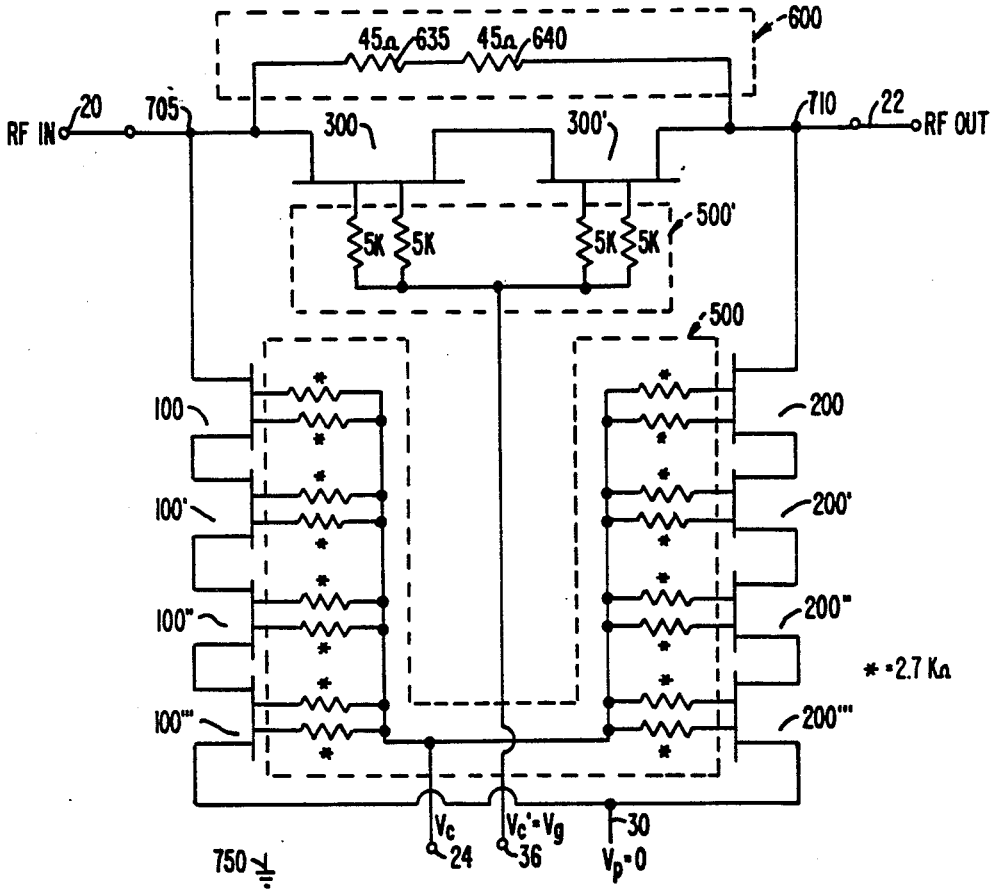
FIG. 13 is a schematic of a third embodiment of an attenuator according to the present invention.

FIG. 13 is the schematic of a third preferred embodiment of an attenuator. An attenuator according to FIG. 13 operates over a 0–20 GHz range and can dissipate 500 mW at RF circuit input port 20. The relatively large power dissipation of the embodiment of FIG. 13 is achieved by series-connecting multi-gate FETs 100, 100′, 100″, 100‴, FETs 200, 200′, 200″, 200‴, and FETs 300 and 300′ as shown.

Elimination of the AC coupling capacitors 702 and 704 permits the attenuator to operate down to DC. However, to establish 0V DC bias at the RF circuit input port 20 and the RF circuit output port 22 it is necessary to connect the first reference port to ground i.e., Vp=0V. It is also necessary to provide a first control voltage Vc at port 24 and to provide a complementary "push-pull" second control voltage Vc at the second reference port 36, in lieu of the second reference voltage Vg. What is meant by complementary "push-pull" is that if Vc goes from 0V to −3V. Vc simultaneously goes from −3V to 0V. As shown in FIG. 13 first control voltage means 500 is connected between the first control voltage Vc at port 24 and the input lead to each series-connected active device 100, 100′, 100″, 100‴, and 200, 200′, 200″and 200‴. Similarly a second control voltage means 500 is connected between the second control voltage Vc′ at port 36 and the input leads on the third pair of active devices 300 and 300′. As noted, the first reference voltage Vp at port 30 is typically connected to ground 750.

Figure 13A:
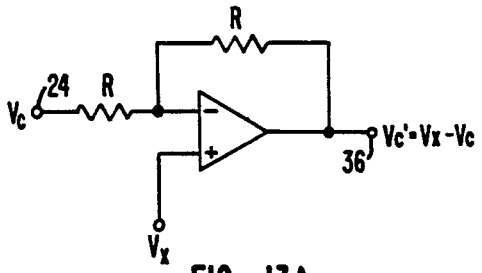
FIG. 13A is a schematic of a complementary control voltage generator for use with the attenuator of FIG. 13.
Figure 14:
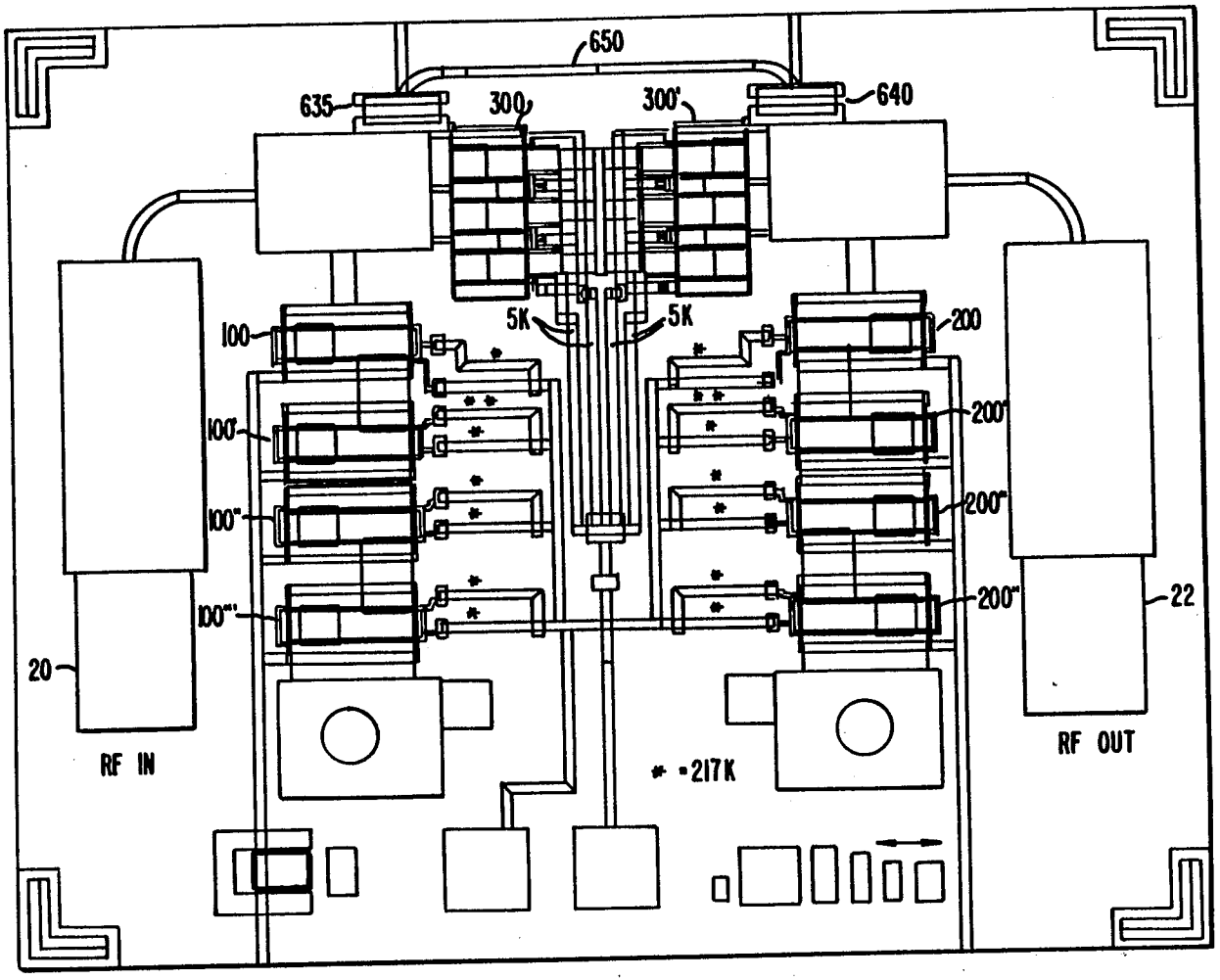
FIG. 14 is a plan view of an MMIC chip showing the components of the attenuator of FIG. 13.
Figure 15:
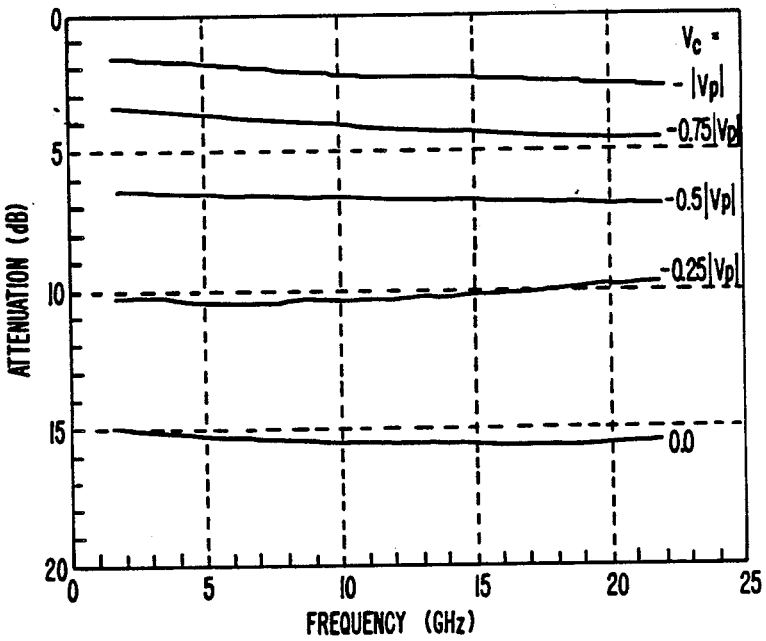
FIG. 15 is a plot of projected attenuation versus frequency for the attenuator of FIG. 13.
Figure 16:
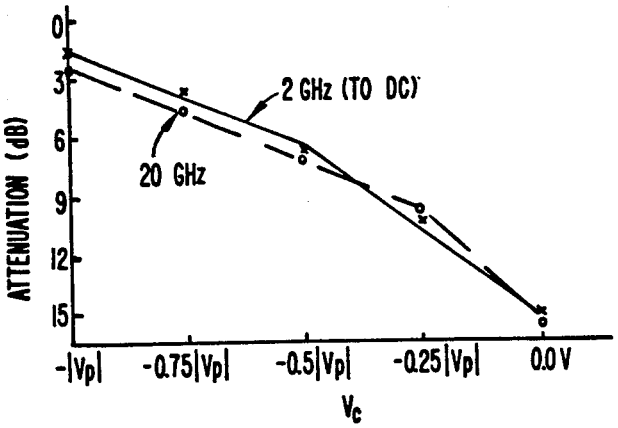
FIG. 16 is a plot of projected attenuation versus control signal magnitude for the attenuator of FIG. 13.

FIG. 13A indicates how the complementary push-pull control voltage Vc may be generated from the single control voltage Vc. An operational amplifier configured as shown and having as an input Vc at port 24 as shown will provide as an output $Vc' = Vx - Vc$. In FIG. 13A, Vx is typically made to equal minus the pinchoff voltage for the FETs, typically about 3V. Thus, with reference to FIG. 13A, if Vc varies from 0V to −3V. Vc will simultaneously vary from −3V to 0V. In the embodiment of FIG. 13, no separate Bias Means 400 is required, and the ground connection at 750 is connected to port 30 rather than to port 36. FIG. 14 is a plan view of an MMIC chip showing the components of the attenuator of FIG. 13. The chip size in FIG. 14 is about 1.4 mm×1.5 mm and the size of each gate in FETs 100, 100′, 100″, 100‴, 200, 200′, 200″, 200‴ is about 0.5μ long by about 320 μ wide, and the size of each gate in FETs 300, 300′, is about 0.5μ long by about 560μ wide. Note that the complementary control signal generator suggested in FIG. 13A is not included on the MMIC chip. The frequency response of Vc and Vc′ may be considerably less than RF microwave and may be DC, and the complementary control voltage generator need not be on the MMIC chip. FIG. 15 and FIG. 16 show projected attenuation versus frequency and control signal characteristics of the embodiment of FIG. 13, while Table I is a side-by-side comparison of the projected specifications for the embodiments of FIG. 2, FIG. 9 and FIG. 13.

TABLE I

| PARAMETERS | FIGS. 2 & 6 | FIGS. 9 & 10 | FIGS. 13 & 14 |
|---|---|---|---|
| FREQUENCY (GHz) | 2–20 | 2–20 | DC–20 |
| INSERTION LOSS max. (dB) | 2.5 | 3.0 | 2.7 |
| ATTENUATION RANGE min. (dB) | 14 | 13 | 13 |
| ATTENUATION RIPPLE P-P max. (dB) | 1.5 | 2.5 | 2 |
| I/O VSWR. max. | 2:1 | 2:1 | 2:1 |
| Ser. No. 329,625 Art Unit 252 | | | -3- |
| POWER IN @1dB COMPRESSION, min (dBm) | +15 | +24 | +27 |
| CONTROL VOLTAGE (Vc) | Single 0 to +3V −5mA<, <5mA | Single 0 to +3V −5mA<, <5mA | Dual 0 to −3V @<−5mA |
| DC BIAS (Vp) | +3V @<5mA | +3V @<5mA | 0V |
| CHIP SIZE (approx. mm × mm) | 1.4 × 1.4 | 1.4 × 1.5 | 1.4 × 1.5 |
| POWER DISSIPATION (mW) | 30 | 250 | 500 |

Modifications and variations may be made to the disclosed embodiment without departing from the scope of the invention as defined by the following claims. For example active variable conductance devices other than FETs may be used providing the characteristics of the substitute devices are modelled to the attenuator circuit or the characteristics of the attenuator circuit are modelled to the substitute devices. Those skilled in the art will recognize that the "π" configuration of the preferred embodiments is convertible into "T" configurations using known transformation techniques. Those skilled in the art will also recognize that the present invention may be used to amplitude modulate the RF input signal by utilizing as the control signal Vc a signal whose amplitude varies with time as a function of the desired amplitude modulation. Further, those skilled in the art will recognize that the present invention may be used to vary attenuation in a microwave system so as to maintain system dynamic range in the presence of a large input signal by inserting additional attenuation as required.

What is claimed is:

1. On a microstripline MMIC, a circuit for attenuating an RF microwave input signal in response to a single control signal, the circuit adapted to receive a first reference voltage, the circuit comprising:

a circuit input port having an input impedance, for receiving the RF microwave input signal from a signal source having a source output impedance; the input signal having a frequency range between about 2 GHz and about 20 GHz:

a circuit output port having an output impedance, for supplying an attenuation fraction of the RF microwave input signal to a load having a load input impedance;

a control port for receiving a single control signal whose amplitude varies the attenuation fraction of the RF microwave input signal reaching the circuit output port;

a first active variable conductance device having a first output lead coupled to the circuit input port, a second output lead coupled to the first reference voltage and a control lead D.C. coupled directly to the control port to receive the single control signal connected to shunt a signal at the RF circuit input port;

a second active variable conductance device having a first output lead coupled to the circuit output port, a second output lead coupled to the first reference voltage and a control lead D.C. coupled directly to the control port to receive the single control signal, connected to shunt a signal at the RF circuit output port;

a third active variable conductance device, having a first output lead coupled to the circuit input port, a second output lead coupled to the circuit output port and D.C. coupled directly to the control port to receive the single control signal, and a control lead coupled to a second reference voltage connected in series with the RF circuit input port and the RF circuit output port;

the conductance of each active device being variable in response to the magnitude of the single control signal;

a frequency dependent D.C. conductive circuit, coupled to the first and second output leads of the third conductive device, for shunting a fraction of the input signal across the third conductive device, where the sum conductance of the frequency dependent circuit and the third conductive device is substantially constant over the frequency range of the input signal, thereby extending the frequency response of the attenuator while linearizing circuit attenuation and maintaining a substantially constant input and output impedance;

the varying conductance of the active devices varying the attenuation between the RF circuit input port and the RF circuit output port as the amplitude of the control voltage varies, while the input and output impedance is maintained substantially constant over a frequency range of about 2–20 GHz.

2. The circuit of claim 1, further including a first frequency dependent A.C. conductive circuit coupled in series with an output lead of the first active variable conductance device and a second frequency dependent A.C. conductive circuit coupled in series with an output lead of the second active variable conductance device, for decoupling the first active variable conductance device from a potential at the circuit input port and for decoupling the second active variable conductance device from a potential at the circuit output port.

3. The circuit of claim 2 wherein the magnitude of the components comprising the frequency dependent D.C. conductive circuit, and the magnitude of the components comprising the first and second frequency dependent A.C. conductive circuits, together with the magnitude of the stray and parasitic conductance associated with the active variable conductive devices cause the attenuation circuit to exhibit a shunt resonant frequency measured across the RF circuit input port, which is substantially the same as a shunt resonant frequency measured across the RF circuit output port, which is substantially the same as a series resonant frequency measured from the RF circuit input port to the RF circuit output port.

4. The circuit of claim 1, further including a resistance in series with an output lead of the first and second active variable devices, for maintaining a substantially constant input and output impedance and for linearizing attenuation of the circuit as a function of the single control signal.

5. The circuit of claim 1, further including a first resistance between the control port and said control lead of the first active variable conductance device, a second resistance between the control port and each control lead of the second active variable conductance device, and a third resistance between the second reference voltage and said control lead of the third active variable conductance device.

6. The circuit of claim 1, wherein the frequency dependent D.C. circuit includes a resistance and an inductance connected in series across the first and second output leads of the third active variable conductance device.

7. The circuit of claim 2, wherein the first frequency dependent A.C. conductive circuit includes a capacitance in series with an output lead of the first active variable conductance device and the second frequency dependent A.C. conductive circuit includes a capacitance in series with an output lead of the second active variable conductance device.

8. The circuit of claim 1, wherein:

each active variable conductance device is a depletion mode field effect transistor including at least one Schottky gate;

a gate lead of the first and second field effect transistors and a source lead of the third field effect transistor being D.C. coupled directly to the control port to receive the single control signal.

9. The circuit of claim 8, wherein:

each field effect transistor has a substantially equal pinch-off voltage. and wherein the absolute magnitude of the first reference voltage is substantially equal to the absolute magnitude of said pinch-off voltage.

10. The circuit of claim 9, wherein the absolute magnitude of the control voltage is less than or equal to the absolute magnitude of said pinch-off voltage.

11. The circuit of claim 10, wherein the control voltage is less than about 3V.

12. The circuit of claim 1 wherein the input impedance is substantially the same as the output impedance.

13. The circuit of claim 1 wherein the input impedance and the source output impedance are substantially equal, and wherein the output impedance and the load impedance are substantially equal.

14. The circuit of claim 8 wherein each gate lead of the first and second field effect transistors is D.C. coupled directly to the control port to receive the single control signal.

15. The circuit of claim 1, wherein:

the first active variable conductance device includes a plurality of series-connected active variable conductive devices; and the second active variable conductance device includes a plurality of series-connected active variable conductive devices.

16. The circuit of claim 15, wherein each active variable conductance device is a depletion mode field effect transistor including at least one Schottky gate.

17. The circuit of claim 16, wherein each gate lead from each field effect transistor comprising the first and second active variable conductance devices and a source lead of the third field effect transistor are D.C. coupled directly to the control port to receive the single control signal.

18. The circuit of claim 16, wherein the first and second field effect transistors each have two gates and wherein, in comparison to a single-Schottky gate field effect transistor, the width of each gate is approximately doubled.

19. On a microstripline MMIC, a circuit for attenuating an RF microwave input signal in response to a single control signal, the circuit adapted to receive a first reference voltage the circuit comprising:

a circuit input port having an input impedance, for receiving the RF microwave input signal from a signal source having a source output impedance: the input signal having a frequency range between about 2 GHz and about 20 GHz:

a circuit output port having an output impedance for supplying an attenuation fraction of the RF microwave input signal to a load having a load input impedance;

a control port for receiving a single control signal whose amplitude varies the attenuation fraction of the RF microwave input signal reaching the circuit output port;

a first depletion mode field effect transistor including at least one Schottky gate functioning as an active variable conductance device, having a drain lead coupled to the circuit input port a source lead coupled to the first reference voltage and a gate lead D.C. coupled directly to the control port to receive the single control signal connected to shunt a signal at the RF circuit input port;

a second depletion mode field effect transistor including at least one Schottky gate functioning as an active variable conductance device having a drain lead coupled to the circuit output port, a source lead coupled to the first reference voltage and a gate lead D.C. coupled directly to the control port to receive the single control signal, connected to shunt a signal at the RF circuit output port;

a third depletion mode field effect transistor including at least one Schottky gate functioning as an active variable conductance device, having a drain lead coupled to the circuit input port a source lead coupled to the circuit output port and D.C. coupled directly to the control port to receive the single control signal, and having a gate lead coupled to a second reference voltage connected in series with the RF circuit input port and the RF circuit output port;

the conductance of each field effect transistor being variable in response to the magnitude of the single control signal;

a frequency dependent D.C. conductive circuit, coupled to the source and drain leads of the third field effect transistor, for shunting a fraction of the input signal across the third field effect transistor where the sum conductance of the frequency dependent circuit and the third field effect transistor is substantially constant over the frequency range of the input signal, thereby extending the frequency response of the attenuator while linearizing circuit attenuation and maintaining a substantially constant input and output impedance;

a first frequency dependent A.C. conductive circuit coupled in series with an output lead of the first field effect transistor for decoupling the first field effect transistor from a potential at the circuit input port;

a second frequency dependent A.C. conductive circuit coupled in series with an output lead of the second field effect transistor for decoupling the second field effect transistor from a potential at the circuit output port;

wherein the magnitude of the components comprising the frequency dependent D.C. conductive circuit and the magnitude of the components comprising the first and second frequency dependent A.C. conductive circuits, together with the magnitude of the stray and parasitic conductance associated with the field effect transistors cause the attenuation circuit to exhibit a shunt resonant frequency measured across the RF circuit input port which is substantially the same as a shunt resonant frequency measured across the RF circuit output port, which is substantially the same as a series resonant frequency measured from the RF circuit input port to the RF circuit output port;

the varying conductance of the field effect transistors varying the attenuation between the RF circuit input port and the RF circuit output port as the amplitude of the control voltage varies, while the input and output impedance is maintained substantially constant, over a frequency range of about 2–20 GHz.

20. The circuit of claim 19, wherein the first and second field effect transistors each have two gates and wherein, in comparison to a single-Schottky gate field effect transistor, the width of each gate is approximately doubled.

21. The circuit of claim 19, further including a resistance in series with an output lead of the first and second field effect transistors, for maintaining a substantially constant input and output impedance and for linearizing attenuation of the circuit as a function of the single control signal.

22. The circuit of claim 19 wherein:

the frequency dependent D.C. circuit includes a resistance and an inductance connected in series across the drain and source leads of the third field effect transistor;

the first frequency dependent A.C. conductive circuit includes a capacitance in series with an output lead of the first field effect transistor; and the second frequency dependent A.C. conductive circuit includes a capacitance in series with an output lead of the second field effect transistor.

23. A microwave system, comprising:

a microwave amplifier having an amplifier output impedance, capable of amplifying and providing as an amplifier output. RF microwave signals having a frequency range of about 2 GHz to about 20 GHz;

a circuit on a microstripline MMIC for receiving as an RF microwave input signal the amplifier output and attenuating the amplifier output in response to a single control signal, the circuit adapted to receive a first reference voltage, the circuit comprising:

a circuit input port having an input impedance, for receiving the RF microwave input signal from a signal source having a source output impedance; the input signal having a frequency range between about 2 GHz and about 20 GHz;

a circuit output port having an output impedance for supplying an attenuation fraction of the RF microwave input signal to a load having a load input impedance;

a control port for receiving a single control signal whose amplitude varies the attenuation fraction of the RF microwave input signal reaching the circuit output port;

a first active variable conductance device, having a first output lead coupled to the circuit input port a second output lead coupled to the first reference voltage and a control lead D.C. coupled directly to the control port to receive the single control signal connected to shunt a signal at the RF circuit input port;

a second active variable conductance device, having a first output lead coupled to the circuit output port, a second output lead coupled to the first reference voltage and a control lead D.C. coupled directly to the control port to receive the single control signal, connected to shunt a signal at the RF circuit output port;

a third active variable conductance device having a first output lead coupled to the circuit input port, a second output lead coupled to the circuit output port and D.C. coupled directly to the control port to receive the single control signal and a control lead D.C. coupled directly to a second reference voltage connected in series with the RF circuit input port and the RF circuit output port;

the conductance of each active device being variable in response to the magnitude of the single control signal;

a frequency dependent D.C. conductive circuit coupled to the first and second output leads of the third conductive device for shunting a fraction of the input signal across the third conductive device, where the sum conductance of the frequency dependent circuit and the third conductive device is substantially constant over the frequency range of the input signal, thereby extending the frequency response of the attenuator while linearizing circuit attenuation and maintaining a substantially constant input and output impedance;

a first frequency dependent A.C. conductive circuit coupled in series with an output lead of the first active variable conductance device for decoupling the first active device from a potential at the circuit input port, and a second frequency dependent A.C. conductive circuit coupled in series with an output lead of the second active variable conductance devices for decoupling the second active device from a potential at the circuit output port;

wherein the magnitude of the components comprising the frequency dependent D.C. conductive circuit and the magnitude of the components comprising the first and second frequency dependent A.C. conductive circuits, together with the magnitude of the stray and parasitic conductance associated with the active variable conductive devices, cause the attenuation circuit to exhibit a shunt resonant frequency measured across the RF circuit input port, which is substantially the same as a shunt resonant frequency measured across the RF circuit output port which is substantially the same as a series resonant frequency measured from the RF circuit input port to the RF circuit output port;

the varying conductance of the active devices varying the attenuation between the RF circuit input port and the RF circuit output port as the amplitude of the control voltage varies, while the input and output impedance is maintained substantially constant over a frequency range of about 2–20 GHz.

24. The system of claim 23, wherein the first and second active variable conductance devices are field effect transistors, each having two Schottky gates and wherein in comparison to a single-Schottky gate field effect transistor the width of each gate is approximately doubled.

25. The system of claim 23, further including means for generating the single control signal as a function of the temperature of the microwave amplifier such that the circuit varies attenuation to compensate for temperature-dependent amplifier gain variations.

26. The system of claim 23 further including means for generating the single control signal as a function of the temperature-dependent and frequency-dependent characteristics of the microwave amplifier such that the circuit varies attenuation to compensate for such amplifier variations.

27. The system of claim 23 wherein the amplifier output is substantially a single frequency of constant amplitude, and wherein the magnitude of the single control signal amplitude modulates the amplifier output.

28. On a microstripline MMIC, a circuit for attenuating an RF microwave input signal in response to a single control signal the circuit adapted to receive a first reference voltage the circuit comprising:

a circuit input port, having an input impedance, for receiving the RF microwave input signal from a signal source having a source output impedance; the input signal having a frequency range between 0 and about 20 GHz:

a circuit output port, having an output impedance, for supplying an attenuation fraction of the RF microwave input signal to a load having a load input impedance;

first and second control ports for receiving, respectively, first and second control signals whose amplitudes vary the attenuation fraction of the RF microwave input signal reaching the circuit output port;

the second control signal varying in complementary push-pull relationship to the first control signal;

a first plurality of active variable conductance devices having a first output lead D.C. coupled directly to the circuit input port a second output lead D.C. coupled directly to the first reference voltage and a control lead D.C. coupled directly to the first control port to receive the first control signal, connected to shunt a signal at the RF circuit input port;

a second plurality of active variable conductance devices, having a first output lead D.C. coupled directly to the circuit output port, a second output lead D.C. coupled directly to the first reference voltage and a control lead D.C. coupled directly to the first control port to receive the first control signal, connected to shunt a signal at the RF circuit output port;

a third plurality of active variable conductance devices having a first output, lead D.C. coupled directly to the circuit input port, a second output lead D.C. coupled directly to the circuit output port; and a control lead D.C. coupled directly to the second control port to receive the second control signal, connected in series with the RF circuit input port and the RF circuit output port;

the conductance of the first and second plurality of active variable conductance devices being variable in response to the magnitude of the first control signal;

the conductance of the third plurality of active variable conductance devices being variable in response to the magnitude of the second control signal; and a frequency dependent D.C. conductive circuit coupled to the first and second output leads of the third conductive device for shunting a fraction of the input signal across the third conductive device where the sum conductance of the frequency dependent circuit and the third conductive device is substantially constant over the frequency range of the input signal thereby extending the frequency response of the attenuator while linearizing circuit attenuation and maintaining a substantially constant input and output impedance;

the varying conductance of the active devices varying the attenuation between the RF circuit input port and the RF circuit output port as the amplitude of the control voltage varies, while the input and output impedance is maintained substantially constant, over a frequency range of 0 to about 20 GHz.

29. The circuit of claim 28, wherein the magnitude of the components comprising the frequency dependent D.C. conductive circuit, together with the magnitude of the stray and parasitic conductance associated with the active variable conductive devices cause the attenuation circuit to exhibit a shunt resonant frequency measured across the RF circuit input port, which is substantially the safe as a shunt resonant frequency measured across the RF circuit output port, which is substantially the safe as a series resonant frequency measured from the RF circuit input port to the RF circuit output port.

30. The circuit of claim 28, wherein each active variable conductance device is a depletion mode field effect transistor comprising at least one Schottky gate; each said field effect transistor having a substantially equal pinchoff voltage;

wherein the magnitude of each control voltage is greater than or equal to said pinch-off voltage.

31. The circuit of claim 30, wherein the field effect transistors each have three gates and wherein in comparison to a single-Schottky gate field effect transistor the width of each gate is approximately tripled.

32. The circuit of claim 28 further including means for receiving the first control voltage and generating therefrom the second control voltage.

33. A microwave system, comprising:

a microwave amplifier having an amplifier output impedance capable of amplifying and providing as an amplifier output. RF microwave signals having a frequency range of 0 to about 20 GHz;

a circuit on a microstripline MMIC for receiving as an RF microwave input signal the amplifier output and attenuating the amplifier output in response to a single control signal the circuit adapted to receive a first reference voltage, the circuit comprising:

a circuit input port having an input impedance for receiving the RF microwave input signal from a signal source having a source output impedance: the input signal having a frequency range between about 0 GHz and about 20 GHz:

a circuit output port having an output impedance for supplying an attenuation fraction of the RF microwave input signal to a load having a load input impedance:

first and second control ports for receiving; respectively, first and second control signals whose amplitudes vary the attenuation fraction of the RF microwave input signal reaching the circuit output port;

the second control signal varying in complementary push-pull relationship to the first control signal;

a first plurality of active variable conductance devices having a first output lead D.C. coupled directly to the circuit input port a second output lead D.C. coupled directly to the first reference voltage and a control lead D.C. coupled directly to the first control port to receive the first control signal, connected to shunt a signal at the RF circuit input port;

a second plurality of active variable conductance devices having a first output lead D.C. coupled directly to the circuit output port, a second output lead D.C. coupled directly to the first reference voltage and a control lead D.C. coupled directly to the first control port to receive the first control signal, connected to shunt a signal at the RF circuit output port:

a third plurality of active variable conductance devices having a first output lead D.C. coupled directly to the circuit input port, a second output lead D.C. coupled directly to the circuit output port; and a control lead D.C. coupled directly to the second control port to receive the second control signal connected in series with the RF circuit input port and the RF circuit output port;

the conductance of the first and second plurality of active variable conductance devices being variable in response to the magnitude of the first control signal;

the conductance of the third plurality of active variable conductance devices being variable in response to the magnitude of the second control signal; and a frequency dependent D.C. conductive circuit coupled to the first and second output leads of the third conductive device, for shunting a fraction of the input signal across the third conductive device where the sum conductance of the frequency dependent circuit and the third conductive device is substantially constant over the frequency range of the input signal, thereby extending the frequency response of the attenuator while linearizing circuit attenuation and maintaining a substantially constant input and output impedance;

wherein the magnitude of the components comprising the frequency dependent D.C. conductive circuit together with the magnitude of the stray and parasitic conductance associated with the active variable conductive devices, cause the attenuation circuit to exhibit a shunt resonant frequency measured across the RF circuit input port which is substantially the same as a shunt resonant frequency measured across the RF circuit output port which is substantially the same as a series resonant frequency measured from the RF circuit input port to the RF circuit output port;

the varying conductance of the active devices varying the attenuation between the RF circuit input port and the RF circuit output port as the amplitude of the control voltage varies, while the input and output impedance is maintained substantially constant over a frequency range of 0 to about 20 GHz.

34. The system of claim 33, wherein each active variable conductance device is a depletion mode field effect transistor comprising at least one Schottky gate, each field effect transistor having a substantially equal pinch-off voltage, and wherein the magnitude of each control voltage is less than or equal to the pinch-off voltage.

35. The system of claim 34, wherein the field effect transistors each have three gates and wherein, in comparison to a single-Schottky gate field effect transistor, the width of each gate is approximately tripled.

36. The system of claim 33, further including means for generating the first and second control signals as a function of the temperature of the microwave amplifier such that the circuit varies attenuation to compensate for temperature-dependent amplifier gain variations.

37. The system of claim 33, further including means for generating the first and second control signals as a function of the temperature-dependent and frequency-dependent characteristics of the microwave amplifier such that the circuit varies attenuation to compensate for such variations.

38. The system of claim 33 wherein the amplifier output is substantially a single frequency of constant amplitude and wherein the magnitude of the first and second control signals amplitude modulate the amplifier output.

* * * * *